US007031649B2

(12) United States Patent
Matsuura

(10) Patent No.: US 7,031,649 B2
(45) Date of Patent: Apr. 18, 2006

(54) IMAGE FORMING APPARATUS

(75) Inventor: Taisuke Matsuura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 10/853,108

(22) Filed: May 26, 2004

(65) Prior Publication Data

US 2004/0253025 A1 Dec. 16, 2004

(30) Foreign Application Priority Data

Jun. 11, 2003 (JP) ..... 2003-166877

(51) Int. Cl.
*G03G 15/16* (2006.01)

(52) U.S. Cl. ..... 399/316; 399/388

(58) Field of Classification Search ..... 399/121, 399/297, 310, 316, 317, 388, 390
See application file for complete search history.

(56) References Cited

U.S. PATENT DOCUMENTS 5,867,761 A * 2/1999 Ishida et al. ..... 399/388
6,516,179 B1 * 2/2003 Sawai et al. ..... 399/388
6,640,078 B1 * 10/2003 Ishii et al. ..... 399/316
6,650,866 B1 * 11/2003 Ahl et al. ..... 399/388
6,687,479 B1 * 2/2004 Leute et al. ..... 399/316
6,701,119 B1 * 3/2004 Tomiki et al. ..... 399/316

FOREIGN PATENT DOCUMENTS

| | | |
|---|---|---|
| JP | 07-56451 | 3/1995 |
| JP | 10-48969 | 2/1998 |
| JP | 10-171258 | 6/1998 |
| JP | 10-250891 | 9/1998 |
| JP | 11-338276 | 12/1999 |

* cited by examiner

*Primary Examiner*—Hoan Tran
(74) *Attorney, Agent, or Firm*—Fitzpatrick, Cella, Harper & Scinto

(57) ABSTRACT

In an image forming apparatus including a transfer apparatus which transfers a toner image formed on an image bearing member to a transfer material in a transfer portion and a guide member which guides the transfer material conveyed toward the transfer portion, a contact portion which comes into contact with the transfer material in the guide member is made of a material which is charged in the same polarity as toner by friction against the transfer material, and surface resistivity is not lower than $10^3$ Ω/sq and not more than $10^{11}$ Ω/sq.

7 Claims, 4 Drawing Sheets

IMAGE FORMING APPARATUS

BACKGROUND OF THE INVENTION

1. Field of the Invention

The present invention relates to an image forming apparatus which includes a guide member guiding a transfer material to a transfer portion in the image forming apparatus such as a printer, a copying machine, and a facsimile.

2. Related Background Art

A guide member guiding a transfer material (paper or resin film) to which a toner image borne on an image bearing member (photosensitive drum or intermediate transfer belt) is transferred to a transfer portion between the image bearing member and a transfer member is well known.

It is preferable that the transfer material is conveyed along the image bearing member without forming a gap between the image bearing member and the transfer material before the transfer material runs into a transfer electrical field area formed by applying transfer bias to the transfer member. At this point, in the case where there is the gap between the image bearing member and the transfer material, when the toner image is moved from the image bearing member to the transfer material, the toner image flies away or abnormal discharge is generated in the gap, which sometimes results in the generation of the defective image.

Therefore, it is necessary that the transfer material is conveyed along the image bearing member from before running into the transfer electric field area, the guide member has a configuration in which the guide member is close to the image bearing member or the transfer electric field area in order to improve position accuracy at which the transfer material runs into the image bearing member.

However, when the guide member is close to the image bearing member or the transfer electric field area, contamination is easily generated by toner. Namely, the unnecessary toner easily adheres to the transfer material. When the toner adheres to the guide member, a problem that the transfer material guided by the guide member is contaminated by the toner is generated. Further, when the guide member is close to the transfer member, there is also the problem that transfer bias applied to the transfer member leaks to the guide member.

Because of the nature of the guide member, the guide member is strongly slid with the transfer material during a conveying process in which the transfer material is conveyed to the transfer electric field area. Therefore, depending on the configuration of the transfer portion, sometimes the transfer material is frictionally charged by the excessive slide between the transfer material and the guide member. When the transfer material is frictionally charged, since charge on the transfer material disturbs the movement of the toner to the transfer material by the transfer bias, the transfer from the image bearing member to the transfer material does not occur and the toner remains on the image bearing member. As a result, the transfer image appears as the abnormal image. At this point, in the case where the transfer material is in a dry state or in the case where the configuration of the guide member in the image forming apparatus has the strong slide with the transfer material, the abnormal image becomes remarkable.

Namely, the above-described drawbacks are as follows:

(1) the toner contamination of the guide member;

(2) the leakage of the transfer bias to the guide member; and (3) the charging of the transfer material caused by the slide between the transfer material and the guide member.

In order to prevent the drawbacks, some inventions concerning the guide member have been made.

With reference to (1) the toner contamination of the guide member, there has been made the invention in which potential of the guide member charged by the slide with the transfer material is held in the same polarity as the toner in such a manner that the guide member is formed by a conductive member and the bias having the same electric polarity as the toner is applied or the guide member made of the conductive member is grounded through a varistor, or the invention in which repulsion of the toner is generated in such a manner that the guide member is made of an insulating material and a triboelectric series with the transfer material is caused to be the same polarity as the toner (see Japanese Patent Application Laid-Open No. H07-056451 and Japanese Patent Application Laid-Open No. H11-338276).

With reference to (2) the leakage of the transfer bias to the guide member, there is the invention in which on a structure in which, on the bias having the same polarity as the toner is applied to the inside conductive member, the conductive member is cover with the insulating member and the leakage of the transfer bias is prevented (see Japanese Patent Application Laid-Open No. 10-171258).

With reference to (3) the charging of the transfer material caused by the slide between the transfer material and the guide member, there has been made the invention in which the guide member is grounded to remove the excess charge on the transfer material while the guide member has the configuration like (1) and (2) (see Japanese Patent Application Laid-Open No. H10-048969 and Japanese Patent Application Laid-Open No. H10-250891).

However, in the conventional technology, all the problems (1), (2), and (3) can not be solved with the simple configuration.

SUMMARY OF THE INVENTION

In view of the foregoing, it is an object of the invention to provide the image forming apparatus having the simple configuration which can eliminate the transfer material contamination caused by the toner contamination of the guide member while preventing the creation of the abnormal image caused by the friction between the guide member and the transfer material.

In order to achieve the above-described object, a preferred image forming apparatus of the invention includes:

image forming means for forming a toner image on an image bearing member;

transferring means for transferring the toner image on the image bearing member to a transfer material in a transfer portion; and a guide member which guides the transfer material conveyed toward the transfer portion, wherein a contact portion which comes into contact with the transfer material in the guide is made of a material which is charged in the same polarity as toner by friction against the transfer material, and surface resistivity is not lower than $10^3$ Ω/square (hereinafter, referred to as Ω/sq) and not more than $10^{11}$ Ω/sq.

DETAILED DESCRIPTION OF THE PREFERRED EMBODIMENTS

Figure 1:
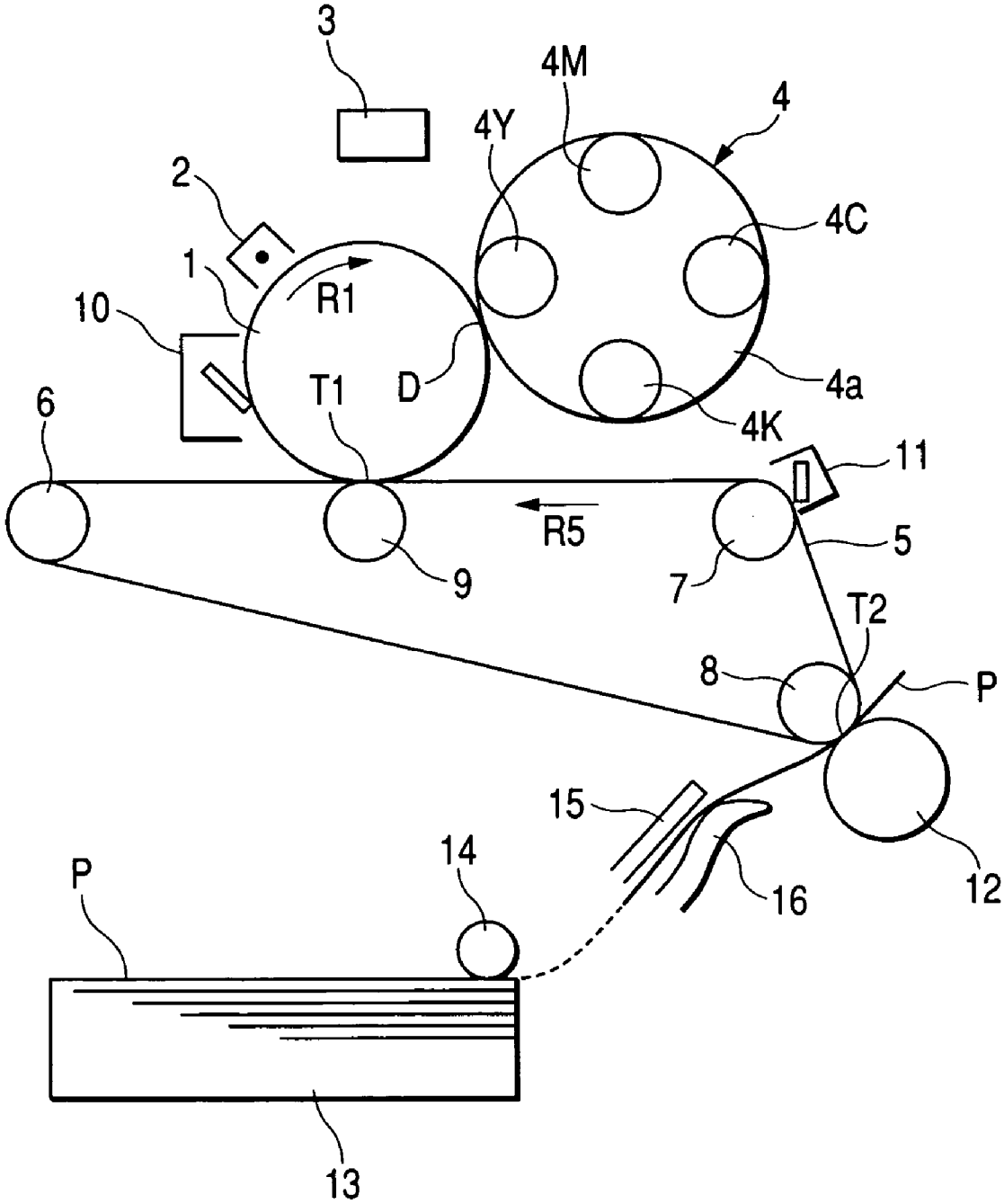
FIG. 1 is a longitudinal sectional view showing a schematic configuration of an image forming apparatus of a first embodiment.

Preferred embodiments of the invention will be described below referring to the accompanying drawings. In each drawing, the same constituents or functions are indicated by the same reference numerals and signs. Thus, the same explanation is omitted.

[First Embodiment]

FIG. 1 shows the image forming apparatus according to a first embodiment as an example of the image forming apparatus according to the invention. The image forming apparatus shown in FIG. 1 is an electrophotographic type of four-color, full-color printer, and FIG. 1 is a longitudinal sectional view showing a schematic configuration of the image forming apparatus.

The image forming apparatus includes a drum type electrophotographic photosensitive member (hereinafter referred to as "photosensitive drum") 1 as a first image bearing member. The photosensitive drum 1 is rotatably supported by a main body (not shown) of the image forming apparatus and rotated at predetermined process speed (peripheral speed) in a direction of an arrow R1 by driving means (not shown).

In the photosensitive drum 1, a surface of the photosensitive drum 1 is uniformly charged to a predetermined potential and polarity by a primary charging device 2 during the rotation. In the charged photosensitive drum 1, an electrostatic latent image corresponding to a first color component image (for example, yellow color component image) of a target color image is formed by undergoing image exposure with an exposing apparatus (exposing means). For example, the exposing apparatus is a color separation and focusing exposure optical system of a color original image or a scanning exposure system including a laser scanner which outputs a laser beam modulated according to a time-series electric digital image signal of image information.

The electrostatic latent image is developed by a developing apparatus (developing means) 4. The developing apparatus 4 includes a rotatable rotary 4*a* and four developing devices mounted on the rotary 4*a*. The four developing devices includes a yellow (first) developing device 4Y, a magenta (second) developing device 4M, a cyan (third) developing device 4C, and a black (fourth) developing device 4K. The electrostatic latent image formed on the photosensitive drum 1 is arranged at a developing position where the yellow developing device 4Y faces the photosensitive drum 1 by the rotation of the rotary 4*a*, and yellow toner adheres by applying developing bias to a developing sleeve (not shown) to develop the electrostatic latent image as a yellow toner image. At this point, operations of the second to fourth developing devices 4M, 4C, and 4K are turned off, and the second to fourth developing devices 4M, 4C, and 4K do not act on the photosensitive drum 1, so that the yellow toner image developed by the first developing device 4Y is not affected by the second to fourth developing devices 4M, 4C, and 4K.

An intermediate transfer belt 5 is provided as a second image bearing member below the photosensitive drum 1. The intermediate transfer belt 5 is formed in an endless shape and entrained on a driving roller 6, a driven roller 7, and a secondary transfer facing roller 8. A primary transfer roller 9 provided inside presses the intermediates transfer belt 5 against the surface of the photosensitive drum 1, which forms a primary transfer nip portion (primary transfer portion) T1 between the photosensitive drum 1 and the intermediate transfer belt 5. The intermediate transfer belt 5 rotates (runs) at the same peed as the process speed of the photosensitive drum 1 in the direction of an arrow R5 according to the counterclockwise rotation of the driving roller 6. The transfer bias is applied to the primary transfer roller 9 by a primary transfer bias applying power source (not shown) in timing with arrival of the yellow toner image formed on the photosensitive drum 1 at the primary transfer nip portion T1, which primarily transfers the yellow toner image on the photosensitive drum 1 to the intermediate transfer belt 5.

After the yellow toner image is transferred, the remaining transfer toner is removed from the surface of the photosensitive drum 1 by a drum cleaner 10 to prepare the next image formation.

The image forming process for the yellow toner image, i.e. each process of the charging, the exposure, the development, the primary transfer, and the cleaning, is similarly repeated for three colors (magenta, cyan, and black) except the yellow. Therefore, the four toner images are superposed on the intermediate transfer belt 5.

The primary transfer bias which primarily transfers the yellow, magenta, cyan, and black toner images from the photosensitive drum 1 to the intermediate transfer belt 5 in order has a polarity (+) reverse to the toner, and the primary transfer bias applying power source applies the primary transfer bias. The applied voltage ranges from +100 to +2000 volts.

At a position across the intermediate transfer belt 5 from the driven roller 7, a belt cleaner 11 is arranged while abutting on the intermediate transfer belt 5. The belt cleaner 11 removes the toner (transfer remaining toner) remaining on the intermediate transfer belt 5 after the later-mentioned secondary transfer of the toner image, and the belt cleaner 11 is separated from the surface of the intermediate transfer belt 5 until the secondary transfer of the toner image is finished.

At the position across the intermediate transfer belt 5 from the secondary transfer facing roller 8, a secondary transfer roller (transferring means) 12 is provided so as to be able to come into contact with and separate from the intermediate transfer belt 5. The secondary transfer roller 12 is separated from the intermediate transfer belt 5 until the primary transfer of the yellow, magenta, cyan, and black toner images is finished. The secondary transfer roller 12 forms a secondary transfer nip portion (secondary transfer portion) when the secondary transfer roller 12 is caused to abut on the intermediate transfer belt 5.

The four-color toner images which are primarily transferred so as to be superposed on the surface of the intermediate transfer belt 5 in the above-described manner are transferred to a transfer material P such as paper and resin film in such a manner that the secondary transfer roller 12 is caused to abut on the intermediate transfer belt 5 to apply the secondary transfer bias to the secondary transfer roller 12. The transfer material P stored in a sheet feeding cassette 13 is fed by a sheet feeding roller 14, conveyed by a conveying roller (not shown), and supplied to a secondary transfer nip portion T2 at predetermined timing by a registration roller (not shown). A secondary transfer bias applying power source (not shown) applies secondary transfer bias to the secondary transfer roller 12.

The transfer material P is guided by transfer material guiding means and supplied to the secondary transfer nip portion T2. The transfer material guiding means includes an upper guide member 15 which guides the surface side (the surface to which the toner image is transferred) of the transfer material P and a lower guide member 16 which guides the backside of the transfer material P. The transfer material P is adapted to be supplied to the secondary transfer nip portion T2 while controlled by the guide members 15 and 16. The guide members 15 and 16 are described in detail later.

After the secondary transfer of the toner image, the transfer material P is conveyed to a fixing apparatus (not shown). In the fixing apparatus, the transfer material P is heated and pressed to fix the toner image on the surface. Therefore, the four-color, full-color image is formed.

On the other hand, in the intermediate transfer belt 5 after the secondary transfer of the toner image, the belt cleaner 11 abutting on the surface of the intermediate transfer belt 5 removes the toner remaining on the surface to prepare the transfer of the next toner image.

The above-described image forming apparatus, i.e. the image forming apparatus using the intermediate transfer belt 5 has an advantage that a degree of freedom of selecting thickness, width, length, and the like of the transfer material P is large, compared with the image forming apparatus having the method in which the toner image on the photosensitive drum is transferred to the transfer material borne on a transfer drum by the use of the transfer drum.

Then, the feature of the invention will be described in detail.

Figure 2:
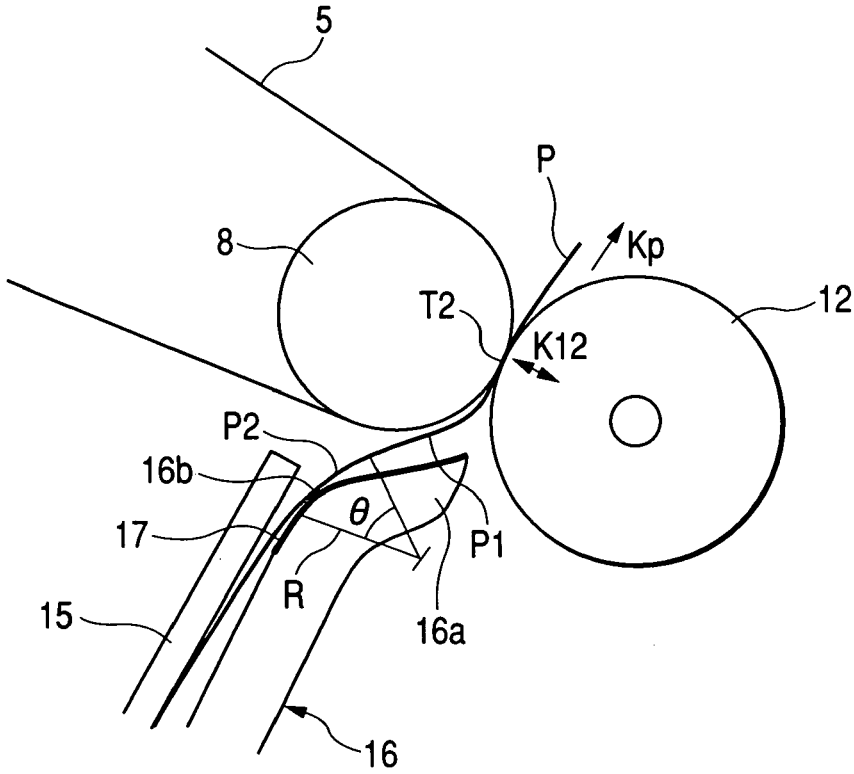
FIG. 2 is an expanded view in the vicinity of guide members and a secondary transfer nip portion in FIG. 1.

FIG. 2 is an expanded view in the vicinity of the secondary transfer nip portion T2 in FIG. 1. The secondary transfer roller 12 shown in FIG. 2 is journaled while arranged in parallel with the secondary transfer facing roller 8 around which the intermediate transfer belt 5 is entrained. The secondary transfer roller 12 is provided so as to be able to come into contact with and separate from the intermediate transfer belt 5 in the direction of an arrow K12. When the toner image on the intermediate transfer belt 5 is secondarily transferred to the transfer material P, the secondary transfer roller 12 is caused to abut on the surface of the intermediate transfer belt 5 to form the secondary transfer nip portion T2 between the intermediate transfer belt 5 and the secondary transfer roller 12. The secondary transfer roller 12 is separated from the intermediate transfer belt 5 at all other times so as not to disturb the toner image on the intermediate transfer belt 5.

The toner image primarily transferred onto the intermediate transfer belt 5 is secondarily transferred to the transfer material P, which is conveyed to the prescribed position by the guide members 15 and 16, at the secondary transfer nip portion T2. A gap between the guide members 15 and 16 is formed not toward the secondary transfer nip portion T2 but toward the secondary transfer facing roller 8. A front end portion 16*a* of the guide member 16 is formed toward the secondary transfer roller 12. In the embodiment, when the transfer material P reaches the secondary transfer nip portion T2, the guide members 15 and 16 are configured so that a first bent portion P1 and a second bent portion P2 are formed in the shape of the transfer material P. The first bent portion P1 and the second bent portion P2 are located on the upstream side of the secondary transfer nip portion T2 along the transfer material conveying direction (direction of an arrow Kp) . The first bent portion P1 is convex toward the secondary transfer roller 12 side (the backside of the transfer material P) and the second bent portion P2 is convex toward the secondary transfer facing roller 8 side (the surface side of the transfer material P). Further, in the embodiment, the second bent portion P2 of the transfer material P is formed so that a curvature radius R is 5 mm and an angle θ is 32°. The transfer material P is adapted to be supplied to the secondary transfer T2 nip portion while the backside in the second bent portion P2 is slid on a convex portion (abutting portion) 16*b* of the guide member 16.

Figure 3:
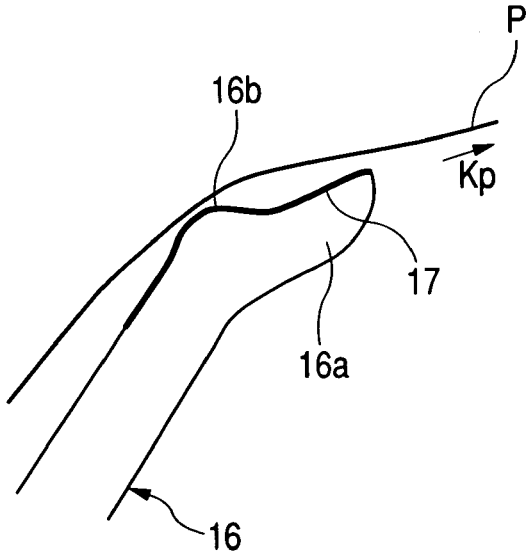
FIG. 3 is a view for explaining the configuration of the lower guide member.

In the embodiment, the guide member 15 guiding the surface side of the transfer material P is made of stainless steel and grounded through a varistor resistor of 100 KΩ. On the other hand, for example as shown in FIG. 3, the guide member 16 guiding the backside of the transfer material P is formed by an insulating member 16*a* whose surface resistivity is not lower than $1\times10^{14}$ Ω/sq, and a semiconducting sheet (semiconducting member) 17 is attached to a part which is strongly slid with the transfer material P. In the embodiment, super-high polymer polyethylene whose surface resistivity is $1\times10^{5}$ Ω/sq is used as the semiconducting sheet 17.

In the semiconducting sheet 17, a triboelectric series generated by the friction with the transfer material P is negatively charged, and self-attenuation occurs after the frictionally charging. The time when the charge on the semiconducting sheet 17 is eliminated by the self-attenuation depends on the surface resistivity. In the embodiment, it is preferable that the surface resistivity of the semiconducting sheet 17 ranges from $1\times10^{3}$ Ω/sq to $1\times10^{11}$ Ω/sq. This is because the semiconducting sheet is not frictionally charged with the transfer material P in the case where the surface resistivity of the semiconducting sheet 17 is lower than $1\times10^{3}$ Ω/sq. On the other hand, in the case where the surface resistivity of the semiconducting sheet 17 is more than $1\times10^{11}$ Ω/sq, the semiconducting sheet 17 is close to the insulating state, and the excess charge generated by the friction with the transfer material P can not be removed by the self-attenuation.

The semiconducting sheet 17 is used for the later-mentioned conveying mode of the transfer material P, the surface resistivity of the semiconducting sheet 17 is set within the above-described range, and the transfer material P is slid on the semiconducting sheet 17 attached to the lower guide member 16. As a result, the proper charging which prevents the toner contamination can be realized and the excessive charging generated by the friction with the transfer material P can be prevented by the self-attenuation.

The negatively charged toner is used as the toner used for the development of the electrostatic latent image. The negative polarity is the same polarity as the charged polarity generated by the friction between the semiconducting sheet 17 and the transfer material P. The above-described effect can be obtained, in the case where the curvature radius R of the second bent portion P2 of the transfer material P is not more than 6 mm and the angle θ is not lower than 30° at the sliding portion between the lower guide member 16 and the transfer material P. In the case where the curvature radius R is more than 6 mm and the angle θ is lower than 30°, the semiconducting sheet 17 is not charged by the proper slide between the transfer material P and the lower guide member 16, which results in the contamination by the flying toner and the like. Therefore, when the surface resistivity of the semiconducting sheet 17 ranges from $1\times10^{3}$ Ω/sq to $1\times10^{11}$ Ω/sq, the removal of the charge of the transfer material P and the effect of the prevention of the toner contamination of the guide member 16 can be optimally obtained on the condition that the curvature of the bent portion P2 in the transfer material p is not more than 6 mm and the angle is not lower than 30°.

The insulating portion of the lower guide member 16 is made of PPE-PS (high polymer compound contains polyphenylene ether and polystylene), and the whole of lower guide member 16 is in the electrically floating state.

The guide members 15 and 16 were formed in the above-described way, and the study was performed by using A3-size 64 g paper (trade name: office planner SK64) as the transfer material P which was left for one week in environment of ordinary temperature and low humidity (temperature: 23° C., and humidity: 5%).

The result of the study of the conventional configuration will be shown below. The transfer material is conveyed to registration roller by the sheet feeding roller and the conveying roller, and the front end of the transfer material passes through the guide member in the conveying process. Then, the transfer material reaches the secondary transfer nip portion located between the intermediate transfer belt and the transfer roller. After the front end of the transfer material reaches the secondary transfer nip portion, the transfer material is conveyed to the secondary transfer nip portion along the lower guide member. At this point, since the lower guide member and the transfer material strongly slide relative to each other, when the guide member is made of the insulating member, the excess charge on the transfer material generated by the friction between the transfer material and the guide member can not be removed. Therefore, the abnormal image is observed in the image after the transfer. When the image formation was continuously performed by the configuration in which the guide member was made of the insulating member, the guide member was contaminated by the toner. When the outputted transfer material was observed, the toner contamination was observed in a part where the transfer material was in contact with the guide member. In the case where the guide member was made by the conductive member and grounded through a varistor, leakage of the transfer bias to the guide member was generated, and defective transfer image appeared due to lack of the transfer bias.

On the contrary, in the embodiment, the semiconducting sheet 17 is attached to the friction portion in the lower guide member 16 where the transfer material P comes into contact with the lower guide member 16. Therefore, the excess charge on the transfer material P generated by the friction with the transfer material P could be removed to obtain the normal transfer image. The semiconducting sheet 17 is attached to the guide member 16 made of the insulating member, and the excess charge on the transfer material P remains on the semiconducting sheet 17. However, since the self-attenuation of the charge occurs in the semiconducting sheet 17, there was no abnormal image even in the case of the continuous sheet feeding. As described above, since the semiconducting sheet 17 was attached to the guide member 16 made of the insulating member, the guide member became the electrically floating state as a whole, and there was no leakage of the transfer bias to the guide member and no occurrence of the abnormal image caused by the lack of transfer current. With reference to the toner contamination of the whole of guide member, the semiconducting sheet 17 has the semiconducting characteristics and the triboelectric series of the semiconducting sheet 17 minutely charged by the friction with the transfer material P is the same polarity as the toner, so that the toner contamination of the transfer material caused by the toner contamination of the guide member 16 could be prevented by the action of repulsion force against the toner. Further, since the guide member 16 had the simple configuration in which the semiconducting sheet 17 was attached to the insulating member, compared with the conventional configuration, higher effect could be obtained at lower cost.

[Second Embodiment]

Figure 4:
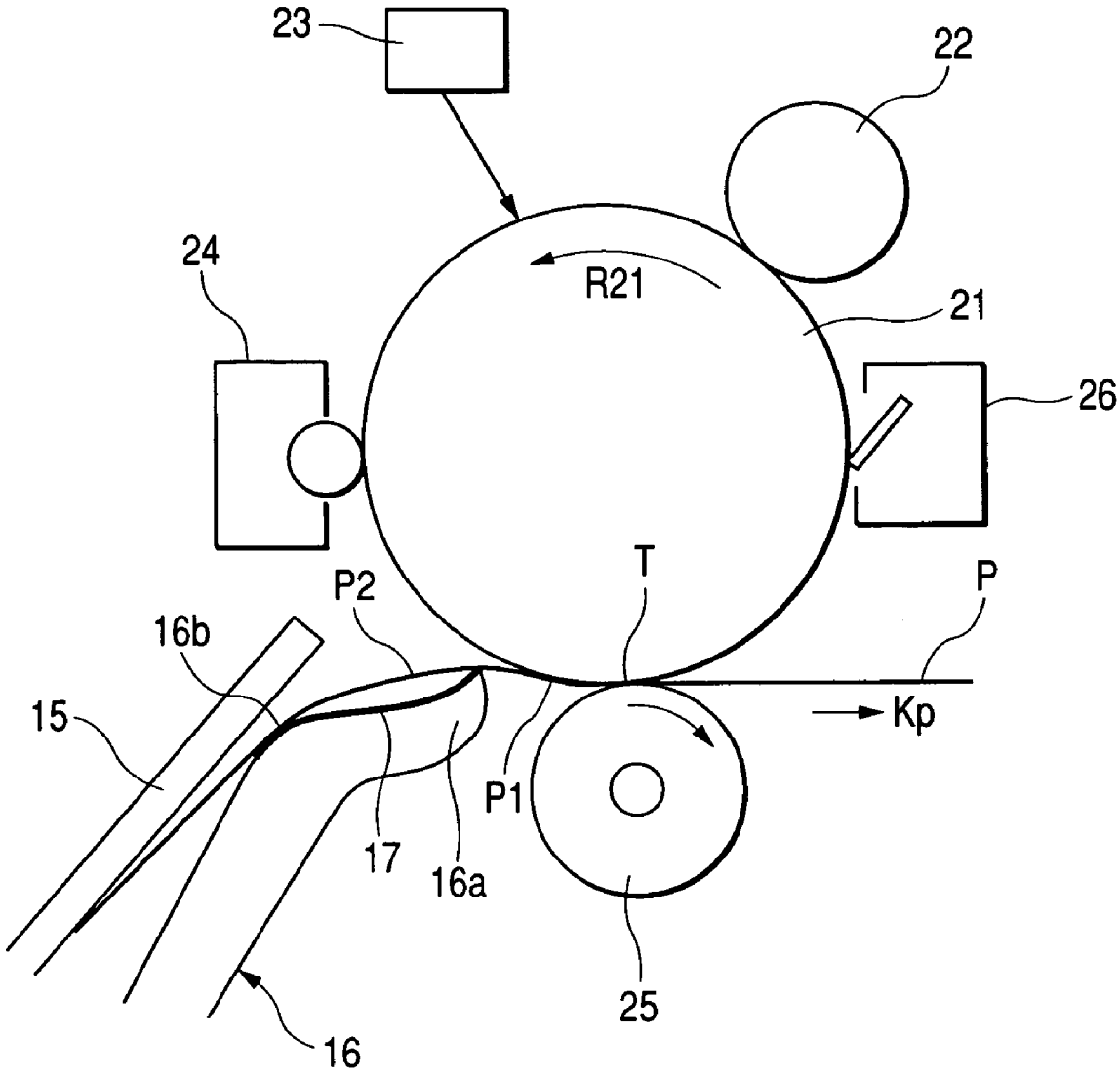
FIG. 4 is a longitudinal sectional view showing the schematic configuration of the image forming apparatus of a second embodiment.
Figure 5:
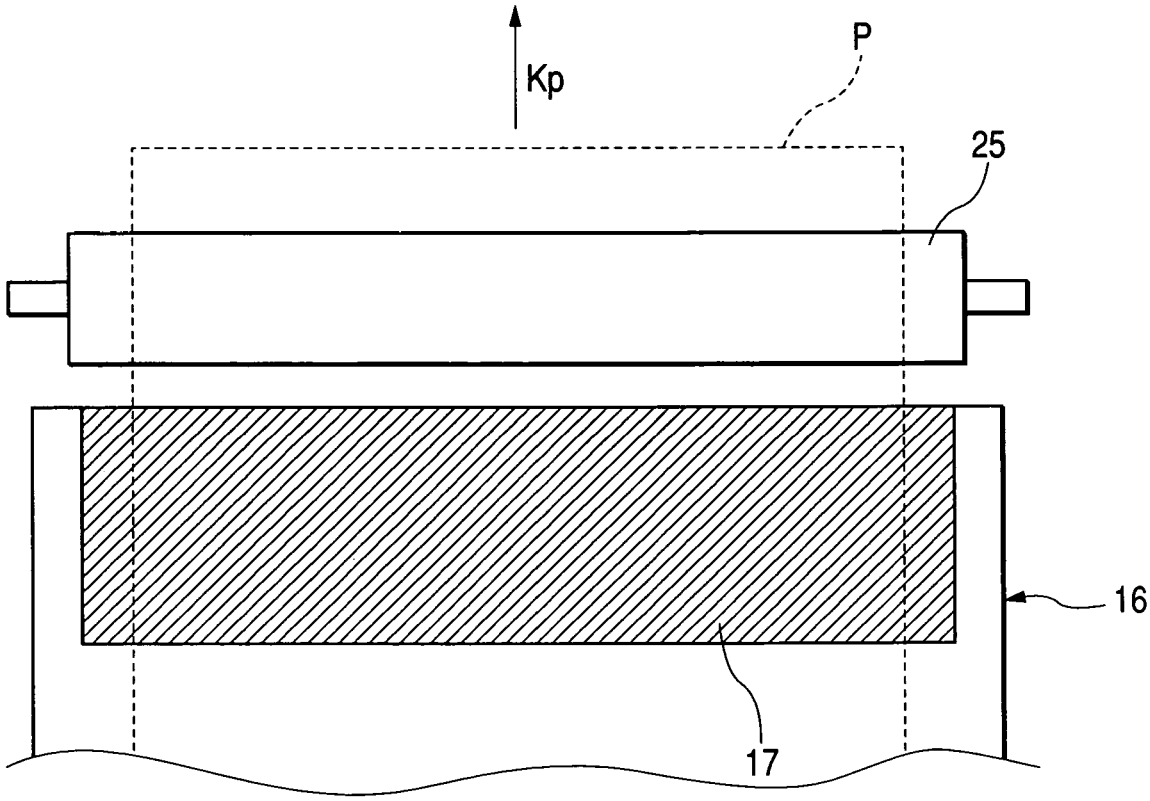
FIG. 5 is a top view showing the lower guide member and a transfer roller in the second embodiment.

FIG. 4 shows an example in which the invention is applied to the single color image forming apparatus. The image forming apparatus shown in FIG. 4 is the electrophotographic type image forming apparatus, and FIG. 4 is the longitudinal sectional view showing the schematic configuration of the image forming apparatus. FIG. 5 is a top view of a transfer roller 22 and a lower guide member 16. The transfer material P is shown by a dotted line.

The image forming apparatus shown in FIG. 4 includes a drum type electrophotographic photosensitive member (photosensitive drum) 21 as the image bearing member. The photosensitive drum 21 is rotatably supported by the main body (not shown) of the image forming apparatus and rotated at predetermined process speed (peripheral speed) in the direction of an arrow R21 by driving means (not shown). The photosensitive drum 21 is uniformly charged to the predetermined potential and polarity by a primary charging device 22 during the rotation. Then, the electrostatic latent image corresponding to a target image is formed by undergoing the image exposure with an exposing apparatus 23.

The black toner adheres to the electrostatic latent image by a developing apparatus (developing means) 24, and the electrostatic latent image is developed as the black toner image.

The black toner image developed on the photosensitive drum 21 is transferred to the transfer material P at a transfer nip portion T which is formed in such a manner that a transfer roller (transfer charging device) 25 abuts on the photosensitive drum 21. The transfer material P stored in the sheet feeding cassette (not shown) is supplied to the transfer nip portion T in timing with the toner image on the photosensitive drum 21 by the sheet feeding roller, the conveying roller and the registration roller, which are not shown, while the transfer material P is guided by the upper guide member 15 and the lower guide member 16. When the transfer material P is supplied to the transfer nip portion T, the transfer bias is applied to the transfer roller 25 by a transfer bias applying power source (not shown), which transfers the toner image on the photosensitive drum 21 to the transfer material P.

After the transfer of the toner image, the transfer material P is conveyed to the fixing apparatus (not shown). In the fixing apparatus, the transfer material P is heated and pressed to fix the toner image on the surface. On the other hand, in the photosensitive drum 21 after the transfer of the toner image, a cleaning apparatus 26 removes the toner remaining on the surface to prepare the transfer of the next toner image.

In the embodiment, the transfer material P is supplied to the transfer nip portion T while guided by the upper guide member 15 and the lower guide member 16.

The guide members 15 and 16 and the semiconducting sheet 17 attached to the lower guide member 16 are the same as the first embodiment, so that the description will be omitted.

In the second embodiment, the same effect as the first embodiment could be obtained by the simple configuration.

The configuration which can achieve thought of the invention is not limited to the above-described embodiments. Needless to say, modifications and variations can be made within the scope in which the effect of the invention can be achieved.

What is claimed is:

1. An image forming apparatus comprising:

image forming means for forming a toner image on an image bearing member;

transferring means for transferring the toner image on said image bearing member to a transfer material in a transfer portion; and a guide member which guides said transfer material conveyed toward said transfer portion, wherein a contact portion which comes into contact with said transfer material in said guide member is made of a material which is charged in the same polarity as toner by friction against said transfer material, and surface resistivity is not lower than $10^3$ Ω/sq and not more than $10^{11}$ Ω/sq.

2. An image forming apparatus according to claim 1, wherein said guide member is formed so as to guide said transfer material toward said image bearing member.

3. An image forming apparatus according to claim 2, wherein said transferring means has a transfer member which can convey said transfer material while sandwiching said transfer material between said image bearing member and the transfer member, and an angle of a bent portion of said transfer material is not lower than 30° in the vicinity of said contact portion, when said transfer material is conveyed by said transfer member while sandwiched between said image bearing member and the transfer member.

4. An image forming apparatus according to claim 2, wherein said transferring means has the transfer member which can convey said transfer material while sandwiching said transfer material between said image bearing member and the transfer member, and a curvature radius of the bent portion of said transfer material is not more than 6 mm in the vicinity of said contact portion, when said transfer material is conveyed by said transfer member while sandwiched between said image bearing member and the transfer member.

5. An image forming apparatus according to claim 1, wherein said guide member has a guide main body and a contact member provided in said contact portion.

6. An image forming apparatus according to claim 5, wherein said guide member has insulating characteristics.

7. An image forming apparatus according to claim 6, wherein said contact portion is in an electrically floating state.

* * * * *